United States Patent [19]

Steere, Jr. et al.

[11] 4,162,730

[45] Jul. 31, 1979

[54] PORTABLE ARTICLE HANGER

[76] Inventors: William H. Steere, Jr.; Marjorie S. Steere, both of 53A Cambridge Ct., Lakewood, N.J. 08701

[21] Appl. No.: 788,548

[22] Filed: Apr. 18, 1977

[51] Int. Cl.[2] ..... A47F 5/01

[52] U.S. Cl. ..... 211/118; 211/119

[58] Field of Search ..... 211/1.3, 104, 106, 112, 211/118, 119, 195

[56] References Cited

U.S. PATENT DOCUMENTS

| | | | |
|---|---|---|---|
| 573,835 | 12/1896 | Taylor | 211/119 |
| 1,367,629 | 2/1921 | Shoemaker | 211/104 |
| 2,198,584 | 4/1940 | Swably | 211/106 X |
| 2,271,941 | 2/1942 | Kemmitt | 211/119 X |
| 2,468,891 | 5/1949 | Neiser | 211/104 X |
| 2,675,130 | 4/1954 | Dore | 211/118 |
| 2,956,689 | 10/1960 | Van Der Togt | 211/104 X |

FOREIGN PATENT DOCUMENTS

| | | | |
|---|---|---|---|
| 973075 | 9/1950 | France | 211/104 |
| 86532 | 1/1966 | France | 211/195 |
| 805348 | 12/1958 | United Kingdom | 211/106 |

*Primary Examiner*—Roy D. Frazier
*Assistant Examiner*—Robert W. Gibson, Jr.
*Attorney, Agent, or Firm*—Bacon & Thomas

[57] ABSTRACT

A portable article hanger is comprised of a planar array of article supports, a member for suspending the array in a substantially horizontal plane, and a member for insuring stability of the planar array within the horizontal plane, when articles are placed on the article supports, by permitting adjustment of the center of gravity of the hanger. The article hanger may be comprised of a plurality of planar array units whereby successive units are adapted for cantilevered engagement with preceeding units, or from opposing ends of a central unit.

5 Claims, 4 Drawing Figures

PORTABLE ARTICLE HANGER

BACKGROUND OF THE INVENTION

1. Field of the Invention

The present invention relates, generally, to portable article hangers which may be folded or otherwise collapsed when not in use, and, more especially, to garment hangers having such features. The present invention is particularly adapted for supporting wet garments during drying thereof.

2. Description of the Prior Art

Various types of portable article hangers, particularly garment hangers, are well known in the art. These hangers commonly are collapsible for ease of storage and may be erected in stable configuration when desired for their intended use. One such device is illustrated in U.S. Pat. No. 121,722, to Keene, which discloses a clothes dryer comprised of a plurality of tubular members held in spatial arrangement and adapted for suspension from a ceiling or wall bracket. Spreader members are employed for stability of the apparatus during use, and are arranged in such a fashion to permit the dryer to be collapsed for storage.

Another conceptually similar device is disclosed in U.S. Pat. No. 1,033,566 to Eschelbacher. This device is designed as a planar array of support elements fastened within a frame member. The hanger is attached, preferably, to a window frame exteriorally of a building. At the point of attachment, hinge-like members are provided in order that the device may be maintained in a substantially vertical plane when not in use, and thence moved to a stable horizontal plane when it is desired to, e.g., dry clothing.

A more common garment hanger is typified by the U.S. Pat. No. 2,271,941 to Kemmitt, which is particularly adapted for use in, for example, a closet to thereby increase the available area for hanging clothing or the like. The Kemmitt device again is comprised of a collapsible planar array of support elements which are suspended by a hook or inverted U-shaped member from a pole or the like within the closet. For storage, it is possible to orient the support elements within a vertical plane to conserve space, and then to rotate those elements to a substantially horizontal plane for supporting articles placed thereon.

Another conventional device employed as an article hanger is typified by Van Der Togt, U.S. Pat. No. 2,956,689, which discloses a structure consisting of a first, fixed article support unit and a second, cantilevered unit pivotally attached thereto. The device is attached to, e.g., a door for stability during use, but may be folded for storage.

These known devices suffer numerous deficiencies. For example, those freely suspended from a horizontal support member lack, to a significant degree, horizontal stability when articles are placed thereon. Thus, the user must carefully balance the clothing or other articles placed on the hanger to avoid an unbalanced condition, which would obviously diminish the desirability of its utilization. In order to provide enhanced stability, on the other hand, certain devices are required to be securely anchored or affixed in a permanent fashion, again diminishing utility by elimination of the portable feature many consumers desire. Compare, for example, U.S. Pat. No. 2,780,365 to Trainor with Eschelbacher, supra.

Significantly, also, the prior art devices are restricted in terms of the quantity of garments which may be supported thereon. Because it is a desirable feature that these devices be compact for storage, the available space for hanging garments is minimized; no provisions being made to provide a device capable of compact portability and yet providing a rather large and stable support unit. While the hanger disclosed by Van Der Togt partially accommodates such desires, the absolute necessity of attaching the device to an auxillary support for stability diminishes its utility.

Accordingly, the need exists to provide a compact portable article hanger exhibiting greater article hanging capabilities than heretofore provided by similar prior art devices. Also, the need exists to provide such an article hanging device which is freely suspendable from a horizontal support, and which allows for adjustment of the center of gravity to provide enhanced stabilization of the device.

SUMMARY OF THE INVENTION

In accordance with the noted, and notable, deficiencies of the prior art, it is a primary object of the present invention to provide an article hanger device which is compact and portable, but which nonetheless exhibits a greater capacity for supporting articles than similar prior art devices.

It is also a primary object of the present invention to provide an article hanger which is designed to permit adjustment of its center of gravity, whereby the device is capable of free suspension from a horizontal support while yet exhibiting a great degree of stability.

Yet another object of the present invention is to provide a portable, compact, garment hanger device particularly adapted for supporting wet clothing during drying thereof.

Still a further object of the present invention is to provide a portable, compact, collapsible garment hanger having a plurality of garment hanging support units, wherein terminal units are cantilevered thereby increasing the capabilities of the device in terms of the number of articles which may be accommodated.

In accordance with the foregoing objects of the present invention, it has been determined that an improved article hanger may be comprised of a planar array of article supports and means for freely suspending same in a substantially horizontal plane. Means are provided in operative communication with both the suspension member and article support units for adjusting the center of gravity of the device in order to insure stability of the device when articles are placed thereon.

The hanger may be fabricated with a plurality of article support units which are in pivotal engagement with one another, whereby successive units may be cantilevered in stable relationship with respect to preceeding units. Also, there may be provided opposing units pivotable from either end of a central unit. Thus, there is provided a compact portable article hanger which, nonetheless, has improved capabilities for supporting a greater number of articles for given overall dimensions of the device.

Yet other objects and advantages of the present invention will become apparent to the skilled artisan upon examination of the following detailed description of the present invention, taken in conjunction with the Figures of Drawing, wherein:

DETAILED DESCRIPTION OF THE INVENTION

The present invention relates, broadly, to article hanger devices and, more especially, to garment hangers. The present invention, most specifically, relates to an improved garment hanger which is collapsible to a storage configuration, and which is provided with cantilevered article support units, and wherein an adjustment feature is provided for altering the center of gravity of the device when the same is in use. For ease of description, the invention will be described in terms of garment hangers; albeit, the skilled artisan will readily appreciate that the present invention is equally well suited for supporting any of a variety of articles (e.g., film strips in connection with amateur film processing). Likewise, in order to fully elucidate upon the various objects and advantages of the present invention, the following detailed description will be given with respect to certain preferred embodiments thereof. However, the same are intended as illustrative, and in no wise limitative.

Figure 1:
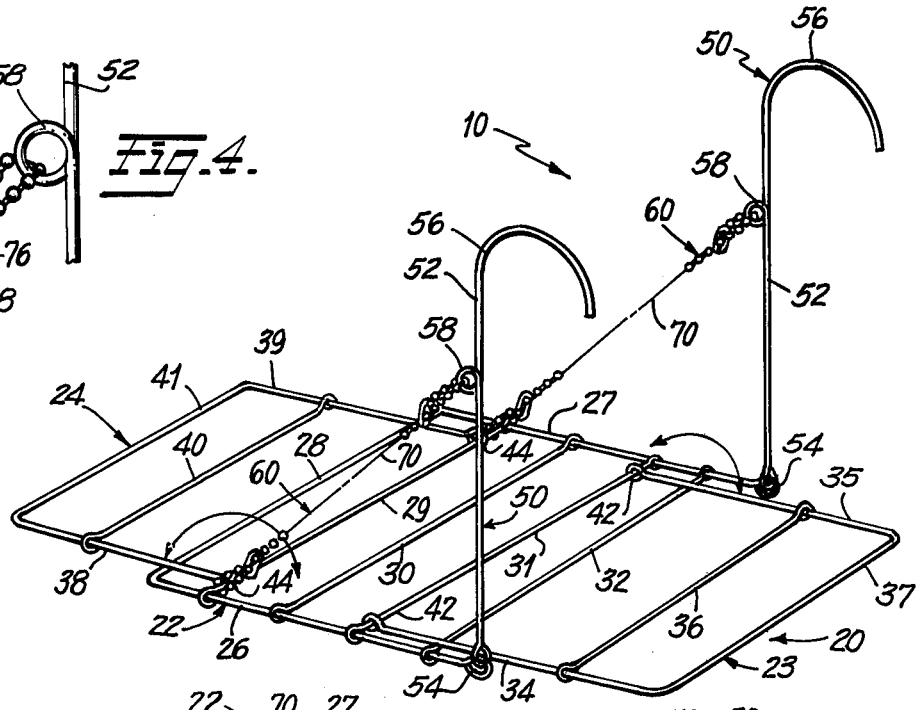
FIG. 1 is a perspective view of the article hanger of the present invention.

The portable garment or article hanger of the present invention, denoted generally as 10, is shown in perspective in FIG. 1. The device is comprised, generally, of a planar array of article supports, denoted generally as 20; a member, 50, for suspending the array in a substantially horizontal plane, and a member, 60, for insuring stability of the planar array within the horizontal plane when articles are placed on the hanger.

The planar array 20 is illustrated as comprised of a central article support unit 22, and a pair of terminal article support units 23, 24, dependent therefrom. Central article support unit 22 is comprised of opposing, substantially parallel frame members 26, 27, and a plurality of transverse article support elements 28–32, inclusive. Similarly, terminal article support unit 23 is comprised of a pair of frame elements 34, 35, and a plurality of transverse article support elements 36, 37. In like manner, the opposing terminal support unit 24 is comprised of opposing frame elements 38, 39, and a plurality of transverse article support elements 40, 41.

The various elements constituting planar array 20 may be fabricated from any of a number of suitable materials. This includes metal wires or tubes of heavy gauge or adequate rigidity to sustain the weight of, for example, wet clothing supported thereon. As an alternative, the various elements might be plastic or polymeric materials, selection of appropriate compositions being well within the skill of the art. Additionally, should the various elements be fabricated from metallic materials, it is highly desirable to provide a plastic or polymeric coating thereon in order to avoid the possibility of discoloration of, e.g., wet clothing which might otherwise result as a consequence of rusting or corrosion thereof. The elements may also be provided with a rubber surface or slight surface abrasion to impart non-slip characteristics.

The transverse article support elements may be secured or affixed to the frame elements in any convenient manner. As illustrated in the Figures of Drawing, these transverse members are in mechanical engagement with the frame members. Thus, it is possible to provide an adjustable, slidable engagement between interior article support elements (e.g., 29, 30, 31) and the frame elements (e.g., 26, 27) whereby the spacing between successive transverse elements may be altered as desired. Obviously, the transverse members might be permanently affixed to the frame elements by, for example, spot welding in the event the device is fabricated from metallic materials or autogenous or ultrasonic welding should the device be fabricated from plastic or polymeric materials.

Figure 2:
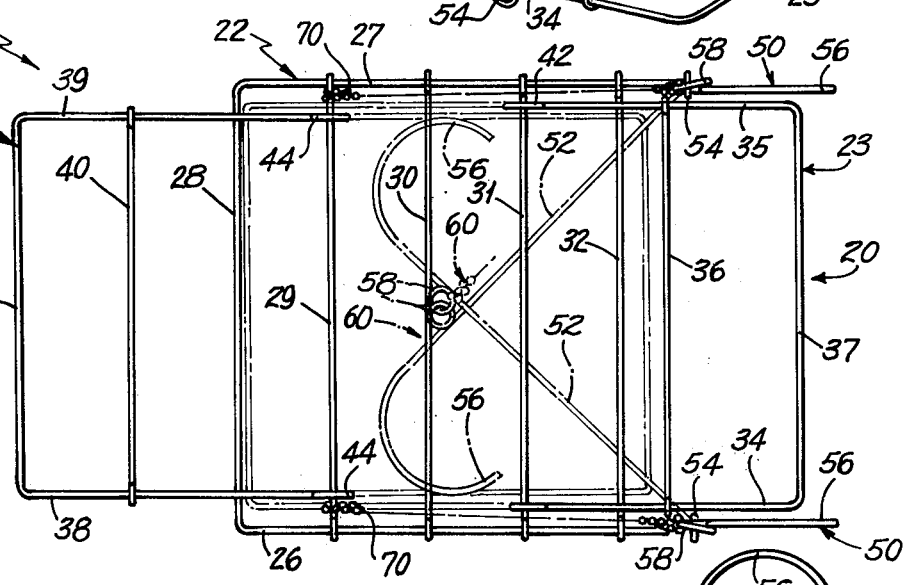
FIG. 2 is a top plan view of the article hanger of the present invention, showing the same in partially folded condition.
Figure 3:
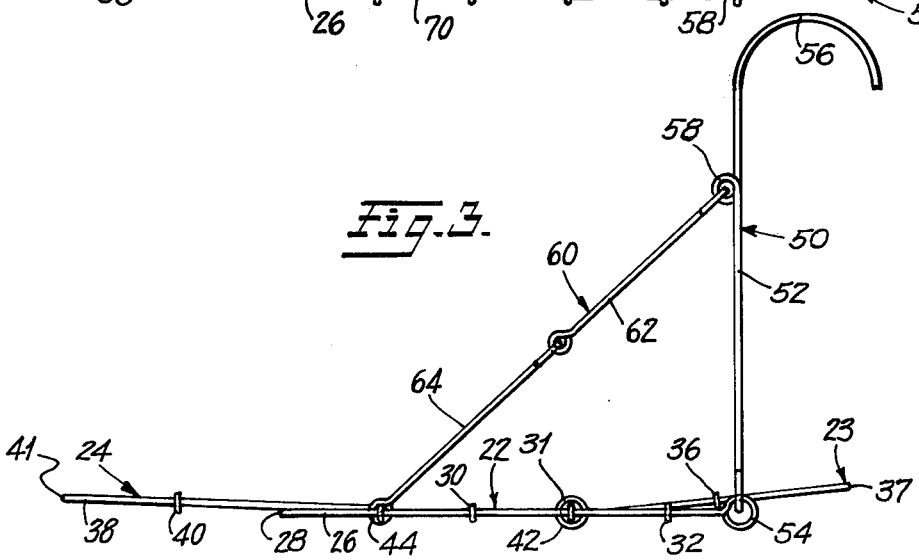
FIG. 3 is a side elevational view of the article hanger in accordance with the present invention; and, FIG. 4 is a fragmentary, side elevational view of the adjustment member for the article hanger.

Each of terminal article support units 23, 24 is received in pivotal engagement with central article support unit 22. As illustrated, article support unit 23 is pivotally received by penultimate transverse element 31 about a hinge or trunnion 42. Similarly, terminal article support unit 24 is received in identical fashion by penultimate transverse element 29 at hinge or trunnion point 44. Therefore, each of terminal article support units 23, 24 may be rotated about the respective transverse article support elements. Thus, when the hanger 10 is unfolded to a position for receiving garments or the like, as shown in FIGS. 1 and 3, the terminal article support units will be pivoted into cantilevered engagement with the ultimate transverse article support elements 28, 32 of central article support unit 22. When the device is folded, for storage, similar to the configuration of FIG. 2, the terminal article support units may be pivoted to lie in a generally nested relationship with respect to central article support unit 2, thereby yielding a highly compact configuration.

The member 50, which is employed to suspend the planar array 20 in a substantially horizontal plane, when the device is in use, is comprised of a pair of opposing suspension elements 52, which may be manufactured from the same materials employed for fabricating planar array 20. Each of suspension elements 52 is received at a hinge or trunnion 54 at one end thereof whereby the suspension member 50 may freely pivot with respect to the planar array 20. The distal end of suspension element 52 terminates in an inverted U-shaped hook 56 adapted for engagement with a horizontal support (not shown) from which the device 10 is suspended. As with the terminal article support units 23, 24, the suspension elements 52 may be pivoted into a folded or compact configuration when the device is not in use, as generally illustrated in FIG. 2.

The members 60, employed for stabilizing the planar array 20 in a substantially horizontal plane when the device is disposed for use, are provided for the alteration of the center of gravity of the hanger 10 when clothing or other articles are placed thereon. That is, since the hanger 10 is not permanently affixed, or otherwise stabilized with respect to a permanent support element, there would be a tendency for the device to rotate about the horizontal support engaged by elements 56 unless the user were to very carefully balance the articles placed on the planar array 20. Such an undesirable consequence is eliminated by means of the adjustment members 60 which are capable of altering the center of gravity of the device 10 whereby any imbalance resulting from the articles placed on planar array 20 may be accommodated.

As illustrated in FIG. 3, the adjustment member 60 may be comprised of a plurality of interengaging wire elements 62, 64, which are in operative communication between an eye 58 on suspension element 52 and the central article support unit 22. While two such interengaging wires are illustrated in FIG. 3, the adjustment member 60 might well be comprised of three or more such wires of appropriate length to allow a usable range of adjustment of the planar array 20 with respect to the support member 50, which is accomplished by inserting or removing a requisite number of wires to alter the angular relationship between array 20 and support 50. More preferable than a plurality of interengaging wires, the adjustment member 60 may be comprised of a chain 70, as best viewed in FIGS. 1 and 4. The chain 70 is fabricated as a plurality of small beads 72 borne, in spaced relationship, on a central wire 74. As with respect to the wire elements 62, 64, the chain is in operative communication with eye 58 and central article support unit 22.

Figure 4:
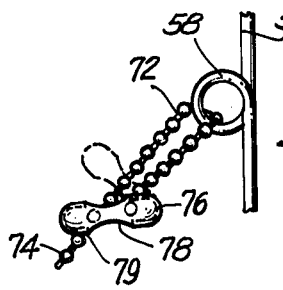

In the embodment depicted in FIG. 4, one terminal end of chain 70 is captured in an adjustment element 76 which is also provided with an aperture 78 and ridge 79. The aperture 78 is substantially larger in dimension than any individual bead 72 whereby the chain 70 may freely pass therethrough when the adjustment element 76 is rotated to a generally perpendicular relationship with respect thereto, as illustrated in phantom lines in FIG. 4. When the chain 70 has been appropriately lengthened or shortened, thereby altering the center of gravity of the hanger 10 by effecting a change in the angular relationship between planar array 20 and suspension members 50, to maintain the former in a substantially horizontal position, the adjustment element 76 may then be rotated as shown in FIG. 4 to cause the ridge 79 to be interposed between successive beads 72 whereby the motion of chain 70 through aperture 78 is precluded. An identical adjustment element 76 may be provided at the other terminal end of chain 70 where the same engages central article support unit 22.

While the drawings illustrate certain of the preferred embodiments of the article hanger of the present invention, myriad modifications may be made without departing from the spirit thereof. For example, rather than providing opposing, terminal article support units 23, 24, only one such unit (e.g., 24, preferably) need be incorporated. Respecting this embodiment, it is thus possible to support the article hanger in a manner similar to that of U.S. Pat. No. 2,956,689 (e.g., from a door) without losing the available option of supporting the hanger from a free horizontal member (e.g., clothes bar in a closet). Along these lines, it is conceivable to pivotally cantilever a number of article support units, seratim, from one end of central article support unit 22. Moreover, while the Figures of Drawing illustrate a generally rectilinear planar array 20, the central article support unit might well be designed with frame elements 26 and 27 in a generally angular relationship, whereby transverse article support elements (e.g., 28–32) could then advantageously be made in an arcuate configuration. Accordingly, the article hanger of the present invention is extremely versatile and enjoys a wide range of applicability. Primarily as a consequence of the ability to alter the center of gravity of the article hanger, in concert with the collapsible nature thereof, the device of the present invention provides all of the advantages attributable to prior art devices, while minimizing the deficiencies thereof, such as, e.g., a lack of stability unless the article hanger is permanently affixed or stabilized by an auxiliary support. That is, the article hanger of the present invention need merely be suspended from a horizontal support and, when articles are placed on the planar array 20, it may be stabilized in a substantially horizontal plane by appropriate adjustment of members 60. Consequently, the article hanger may be suspended from, for example, a horizontal bar in a closet, a shower curtain rail in a bathroom, or the like and appropriately unfolded to present a large surface area for supporting clothing. Thus, the device provides greater article supporting capabilities in terms of available, usable space versus the compact nature of the device when folded for storage. Thus, when collapsed, the device is suitable for packing in a suitcase, for example, for extended trips, and is also highly adapted for use where space is at a premium, such as apartments, recreational vehicles, and the like.

While the invention has now been described in terms of various preferred embodiments, the skilled artisan will readily appreciate that various substitutions, modifications, changes, and omissions, may be made without departing from the spirit thereof. Accordingly, it is intended that the scope of the present invention be limited solely by that of the following claims.

What is claimed is:

1. A portable article hanger adapted for folding into a compact configuration when not in use, comprising:

(a) an article support unit comprised of (i) a central planar array of article support elements comprising a peripheral frame element and a plurality of spaced, transverse article support elements disposed between opposing sides of said frame element and (ii) at least one terminal planar array comprising a peripheral frame element and a plurality of transverse article support elements disposed between said opposing sides of said frame element, said terminal planar array being in pivotal engagement with the penultimate transverse article support element of one end of the central array and adapted for cantilevered engagement with the ultimate article support element thereof, said penultimate transverse article support element being in adjustable slidable engagement with said frame element of said central planar array; and (b) a means for pendulously suspending said article support unit in a plurality of erected positions for actively supporting articles, said suspending means comprising:

(i) a suspension element; and (ii) a linearly adjustable element, which is adapted to be adjusted in length, said linearly adjustable element being in operative engagement with the suspension element and the article support unit for adjustably stabilizing said article support unit in a substantially horizontal plane by changing said article support unit from one erected position to another, whereby the center of gravity of the hanger is altered.

2. The article hanger of claim 1, wherein said article support unit includes a second terminal planar array disposed in pivotal and cantilevered relationship with the opposite end of said central array.

3. The article hanger of claim 1, wherein said linearly adjustable element comprises an adjustable chain fastened to said central planar array at one end and received by said suspension element at the other end thereof.

4. The article hanger of claim 3, wherein said suspending means are comprised of a pair of suspension elements received at one end by said central planar array in pivotal engagement therewith, and terminating in inverted "U-shaped" elements at the opposite end thereof, said suspending means being adapted for supporting said article hanger from a substantially horizontal member.

5. The article hanger of claim 1, wherein said transverse article support elements are in adjustable, slidable engagement with said frame elements.

* * * * *